US009874387B2

(12) United States Patent
Jobb

(10) Patent No.: US 9,874,387 B2
(45) Date of Patent: Jan. 23, 2018

(54) METHOD OF PRODUCING AND PACKAGING ICE CUBES

(71) Applicant: Grant Richard Jobb, Carlisle (CA)

(72) Inventor: Grant Richard Jobb, Carlisle (CA)

( * ) Notice: Subject to any disclaimer, the term of this patent is extended or adjusted under 35 U.S.C. 154(b) by 0 days.

(21) Appl. No.: 15/030,013

(22) PCT Filed: Oct. 10, 2014

(86) PCT No.: PCT/CA2014/000743

§ 371 (c)(1),
(2) Date: Apr. 15, 2016

(87) PCT Pub. No.: WO2015/058278

PCT Pub. Date: Apr. 30, 2015

(65) Prior Publication Data

US 2016/0305698 A1 Oct. 20, 2016

Related U.S. Application Data

(60) Provisional application No. 61/895,193, filed on Oct. 24, 2013.

(51) Int. Cl.

| | |
|---|---|
| ***F25C 1/06*** | (2006.01) |
| ***F25C 1/24*** | (2006.01) |
| ***B65B 5/06*** | (2006.01) |
| ***F25C 5/04*** | (2006.01) |
| *F25C 1/10* | (2006.01) |
| *F25C 1/22* | (2006.01) |
| *F25C 1/00* | (2006.01) |

(Continued)

(52) U.S. Cl.

CPC ..... *F25C 1/06* (2013.01); *B65B 5/06* (2013.01); *F25C 1/243* (2013.01); *F25C 1/246* (2013.01);

(Continued)

(58) Field of Classification Search

CPC .... F25C 1/00; F25C 1/04; F25C 1/045; F25C 1/06; F25C 1/10; F25C 1/20; F25C 1/22;

(Continued)

(56) References Cited

U.S. PATENT DOCUMENTS 1,828,693 A 10/1931 Deventer
2,043,881 A * 6/1936 Buchanan ..... F25C 1/246 249/73

(Continued)

FOREIGN PATENT DOCUMENTS

| | | |
|---|---|---|
| EP | 1516538 | 3/2005 |
| FR | 2619896 | 7/1989 |

(Continued)

OTHER PUBLICATIONS

English translation of JP2006183944.*
International Search Report for PCT/CA2014/000743 dated, Dec. 5, 2014.

*Primary Examiner* — Jianying Atkisson
*Assistant Examiner* — Joel Attey
(74) *Attorney, Agent, or Firm* — Bryan Cave LLP

(57) ABSTRACT

A method of producing ice cubes in a mold and pan in cool ambient air wherein the steps of removing the mold from the pan and removing the ice cubes from the mold are carried out without any heating or thawing to obtain individual ice cubes with a substantially dry outer surface. A method of producing a block of ice cubes in cool ambient air is also provided wherein the steps above are repeated so that the ice cubes drop row above row to produce a block of ice cubes. A method of packaging ice cubes is also provided comprising obtaining a plurality of ice cubes with a substantially dry outer surface and of a stackable shape. The ice cubes are arranged adjacently into a block, and the block is encapsulated in a suitable packaging material.

13 Claims, 6 Drawing Sheets

(51) Int. Cl.
*F25C 1/04* (2006.01)
*F25C 1/20* (2006.01)
*F25C 5/00* (2006.01)

(52) U.S. Cl.
CPC ..... *F25C 5/04* (2013.01); *F25C 1/00* (2013.01); *F25C 1/04* (2013.01); *F25C 1/045* (2013.01); *F25C 1/10* (2013.01); *F25C 1/20* (2013.01); *F25C 1/22* (2013.01); *F25C 1/24* (2013.01); *F25C 5/00* (2013.01); *F25C 2300/00* (2013.01); *F25C 2400/06* (2013.01)

(58) Field of Classification Search
CPC .. F25C 1/24; F25C 1/243; F25C 1/246; F25C 2400/06; F25C 5/00; F25C 5/04; F25C 2300/00
USPC ..... 62/66, 68, 71, 72
See application file for complete search history.

(56) References Cited

U.S. PATENT DOCUMENTS

| | | | | | |
|---|---|---|---|---|---|
| 2,133,219 | A * | 10/1938 | Waldenmeyer | F25C 1/246 | 249/120 |
| 2,236,050 | A | 3/1941 | Anderson | | |
| 2,588,222 | A * | 3/1952 | Ekkebus | F25C 1/243 | 249/120 |
| 2,757,520 | A | 8/1956 | Sampson et al. | | |
| 2,800,775 | A * | 7/1957 | O'Brien | F25C 1/246 | 249/71 |
| 3,217,508 | A | 11/1965 | Beck et al. | | |
| 4,903,506 | A | 2/1990 | Delisle et al. | | |
| 5,263,408 | A * | 11/1993 | Blanchet | B30B 9/04 | 100/125 |
| 6,920,764 | B2 | 7/2005 | Zevlakis | | |
| 7,748,231 | B2 * | 7/2010 | Chung | F25C 5/187 | 477/15 |
| 2005/0056642 | A1 * | 3/2005 | Lion | A21B 3/138 | 220/4.22 |
| 2006/0083833 | A1 | 4/2006 | Pezzana et al. | | |
| 2012/0023996 | A1 * | 2/2012 | Herrera | F25C 1/04 | 62/340 |

FOREIGN PATENT DOCUMENTS

| | | | | |
|---|---|---|---|---|
| GB | 1414901 | | 11/1975 | |
| GB | 2208917 | | 4/1989 | |
| GB | 2423695 | | 9/2006 | |
| JP | 2006183944 | * | 7/2006 | F25C 1/24 |
| WO | 2013064880 | | 5/2013 | |

* cited by examiner

METHOD OF PRODUCING AND PACKAGING ICE CUBES

CROSS-REFERENCE TO RELATED APPLICATIONS

This application is a national stage application under 35 U.S.C. 371 of and claims priority to International Application No. PCT/CA2014/000743, filed Oct. 10, 2014, which claims priority to U.S. Provisional Application No. 61/895,193 filed on Oct. 24, 2013. International Application No. PCT/CA2014/000743 and U.S. Provisional Application No. 61/895,193 are incorporated herein by reference.

FIELD OF INVENTION

This invention relates generally to ice cubes and, for example, to a method of producing and packaging ice cubes on a commercial scale.

BACKGROUND OF THE INVENTION

Commercially produced ice is known in the art. Commercially produced ice is typically built up in layers. Some commercial processes produce cubes by using moulds. In other processes, the ice is formed in a sheet which is subsequently shattered. In either case, heating or thawing is used as part of the stripping process. The heating or thawing decreases the energy efficiency of the ice making process. It also results in the production of ice cubes with wet outer surfaces resulting in ice cubes sticking when placed close together. The "vertical sheet" process produces ice chunks of inconsistent shapes and sizes.

Household refrigerators and freezers having ice-makers similarly employ a heating or thawing process to discharge ice after water is cooled into ice, thus increasing the energy consumption of the ice making process.

It is an object of the present invention to produce ice cubes of consistent shape. It is a further object of the present invention to produce ice cubes having a substantially dry outer surface. It is a still further object of the present invention to provide a stripping process for ice cubes which does not require heat.

SUMMARY OF THE INVENTION

The present invention provides a method of producing ice cubes on a commercial scale. The method comprises obtaining a mould of food grade silicone having a first surface opposite a second surface and a plurality of passages extending therethrough. The method comprises obtaining a pan having a thermally conductive base and having a face coated with a non-stick coating. The thermally conductive base of the pan may be metal. The mould is placed into the pan so that one of the two surfaces of the mould is adjacent the face of the base. The passages are filled with water and the base is cooled to cause the water in the passages to freeze outwardly from the base into ice cubes. The mould is removed from the pan, and the ice cubes are removed from the mould. The steps of removing the mould from the pan and removing the ice cubes from the mould are carried out without any heating or thawing to obtain individual ice cubes with a substantially dry outer surface.

A method of packaging ice cubes is also provided. The method comprises obtaining a plurality of ice cubes having a substantially dry outer surface and of a stackable shape, arranging the ice cubes adjacently into a block, and encapsulating the block in a suitable packaging material. These steps are completed in order. The plurality of ice cubes having a substantially dry outer surface may be obtained through the above-described method.

A method of producing ice cubes in cool ambient air is also provided. The method comprises obtaining a mould of food grade silicone having a first surface opposite a second surface and a plurality of passages extending therethrough. The method comprises obtaining a pan having a base and having a face coated with a non-stick coating. The mould is placed into said pan so that said one of the two surfaces of the mould is adjacent the face of the base. The passages are filled with water and the cool ambient air freezes the water in the passages into ice cubes. The mould is then moved laterally across the face of the pan until the ice cubes are no longer in registration with the face of the pan. Finally, the ice cubes are removed from the mould. The steps of removing the mould from the pan and removing the ice cubes from the mould are carried out without any heating or thawing to obtain individual ice cubes with a substantially dry outer surface.

A method of producing a block of ice cubes in a container that holds the shape of the block of ice cubes and in cool ambient air is also provided. The method comprises (a) obtaining a mould of food grade silicone having a first surface opposite a second surface and a plurality of passages extending therethrough. The method comprises (b) obtaining a pan having a base and having a face coated with a non-stick coating. The mould is then (c) placed into said pan so that said one of the two surfaces of the mould is adjacent the face of the base. The passages are then (d) filled with water and the (e) cool ambient air freezes the water in the passages into ice cubes. The mould is then (f) moved laterally across the face of the pan until the ice cubes are no longer in registration with the face of the pan. Finally at (g) the ice cubes are removed from the mould by pressing against the ice cubes to push the ice cubes through the passages so that the ice cubes drop as a single row into the container. Steps (c)-(g) are repeated so that the ice cubes drop in a row above the single row. The steps of removing the mould from the pan and removing the ice cubes from the mould are carried out without any heating or thawing to obtain individual ice cubes with a substantially dry outer surface.

BRIEF DESCRIPTION OF THE DRAWINGS

Preferred embodiments of the present invention are described below with reference to the accompanying illustrations in which.

DETAILED DESCRIPTION

Figure 1:
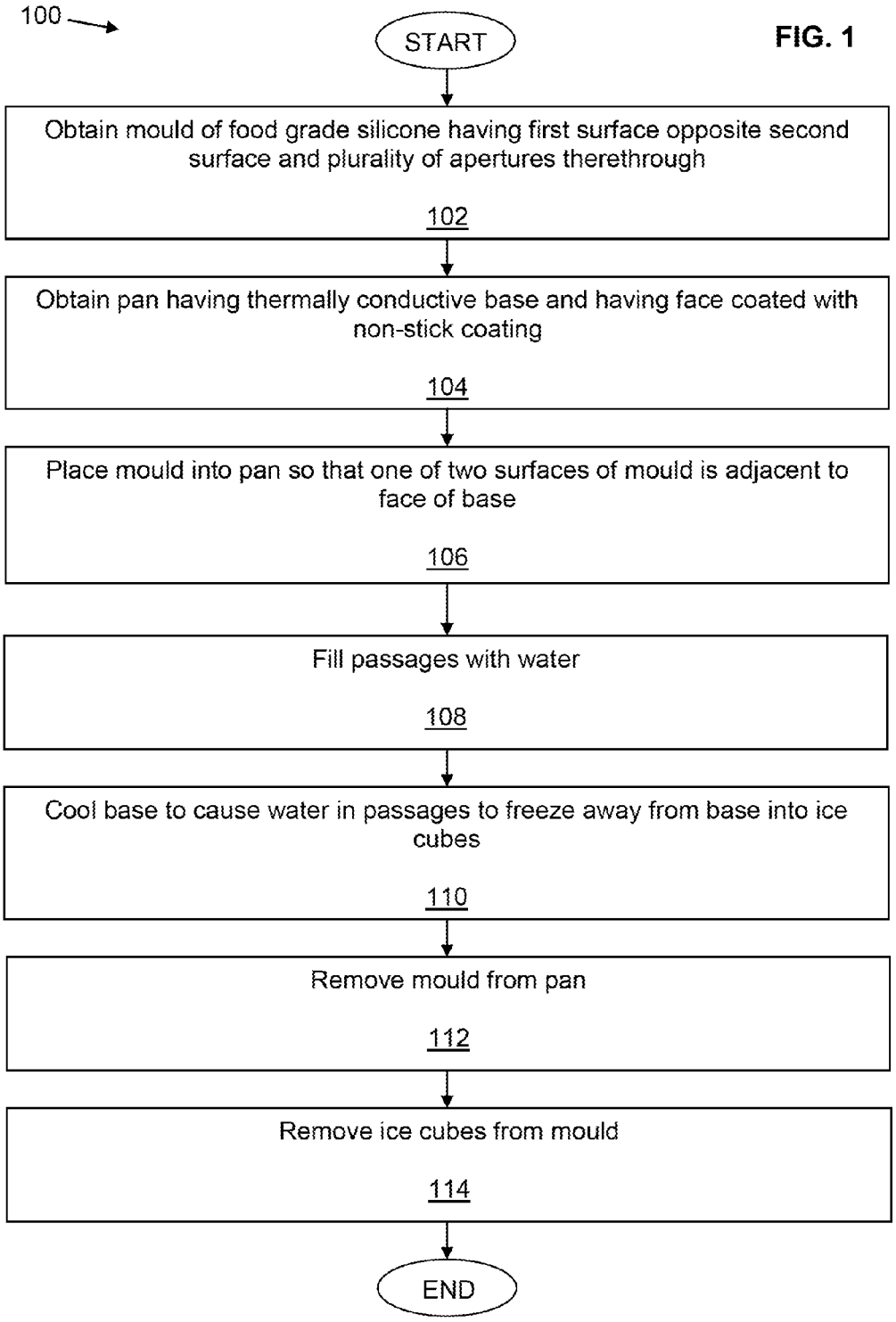
FIG. 1 is a flow chart showing an exemplary method of producing ice cubes with a substantially dry outer surface.
Figure 4:
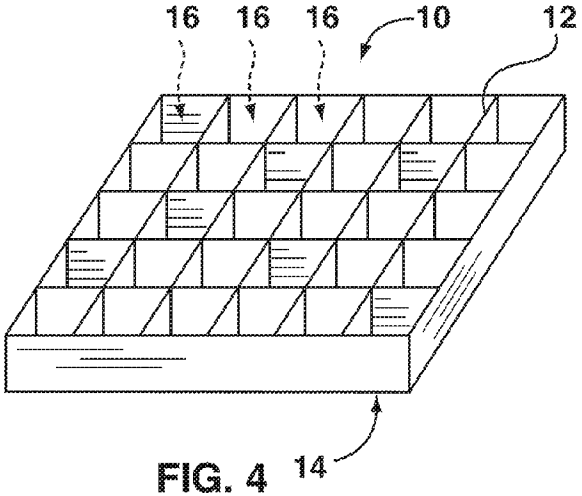
FIG. 4 is a perspective view of an exemplary mould for producing ice cubes of a stackable shape.

Reference is now made to the accompanying illustrations. A method of producing ice cubes on a commercial scale is referenced generally as 100 in accompanying FIG. 1. Ice cubes in the present application refers not just to "cubes" but to any shape with parallel edges extending between a top and bottom face. Preferably, the shapes made are stackable with little or no spaces therebetween. At step 102, a mould 10 of food grade silicone is obtained where the mould 10 has a first surface 12 opposite a second surface 14 and a plurality of passages 16 extending therethrough. The mould 10 may be entirely constructed of food grade silicone or may be coated with food grade silicone. For example, the mould 10 may be constructed of metal for rigidity and coated with food grade silicone. FIG. 4 showing an exemplary mould 10 used for producing ice cubes 50 illustrates passages 16 that could be shaped differently to produce ice cubes 50 of different shapes as discussed below.

Figure 5A:
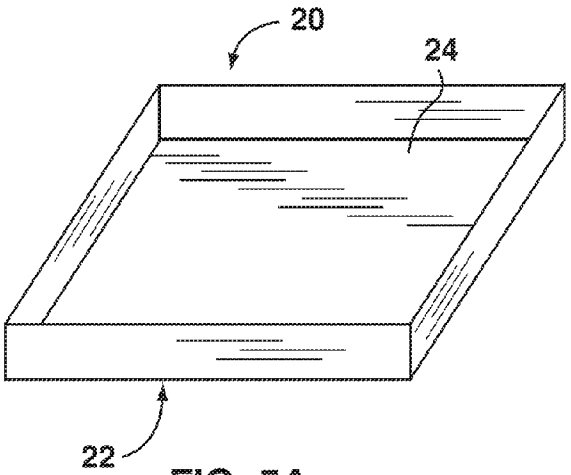
FIG. 5A is a perspective view of an exemplary pan having a depth in which the mould of FIG. 4 is placed.
Figure 5B:
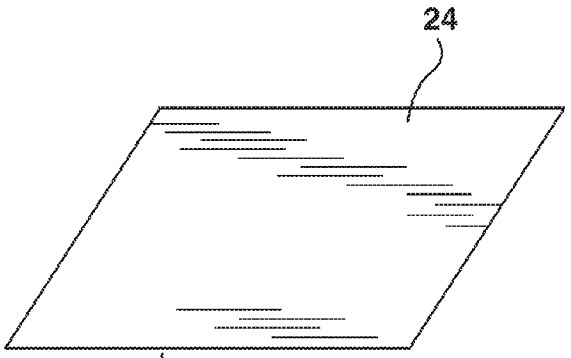
FIG. 5B is a perspective view of an exemplary pan in which the mould of FIG. 4 is placed.
Figure 5C:
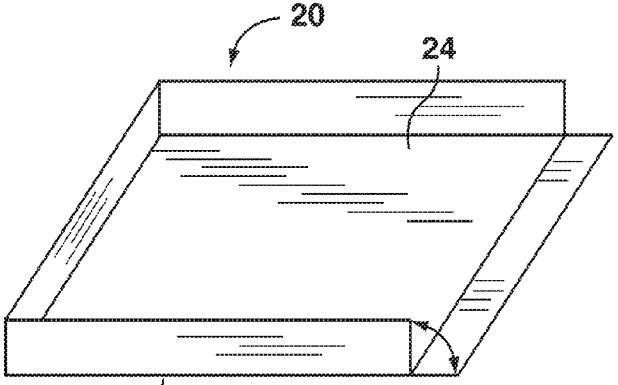
FIG. 5C is a perspective view of an exemplary pan having a hinged side in which the mould of FIG. 4 is placed.

At step 104, a pan 20 is obtained having a thermally conductive base 22. The base 22 of the pan 20 has a face 24 coated with non-stick coating to which ice has little or no adhesion. The non-stick coating may, for example, be of the sort used for "non-stick" oven pans. Although many materials may be used, a base 22 made of metal is contemplated since metals are generally known in the art to have a high thermal conductivity. The pan 20 may have a depth 21 defined by at least one sidewall 25 extending orthogonally from said base 22, as shown in, for example, FIG. 5A. The pan 20, may alternatively have no depth as shown in FIG. 5B. In a further embodiment, the at least one sidewall 25 of the pan 20 may be hingedly joined to the base 22 as shown by the hinged joint 26 in FIG. 5C. This hinged joint 26 will be useful in one embodiment of ice removal step described below.

At step 106, the mould 10 is placed into said pan 20 so that one of the two surfaces, 12 or 14, of the mould is adjacent to the face 24 of the base 22. At step 108, the passages 16 are filled with water.

Figure 6:
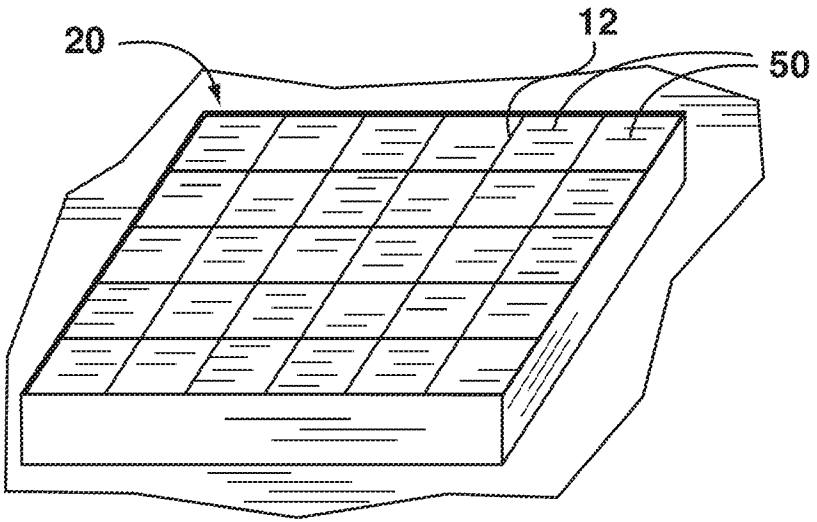
FIG. 6 is a perspective view of the exemplary pan and mould of FIGS. 4 and 5A on a cold surface.
Figure 8B:
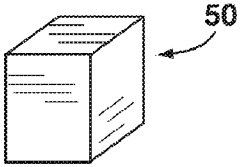
FIG. 8B is a perspective view of an exemplary stackable ice cube shaped as a rectangular prism.
Figure 8A:
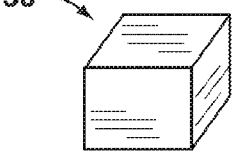
FIG. 8A is a perspective view of an exemplary stackable ice cube shaped as a cube.

At step 110, the base 22 is cooled by placing it on a cold surface 28 to cause the water in the passages 16 to freeze away (upwardly as shown in FIG. 6) from the base 22 into ice cubes 50. As referenced above, the ice cubes 50 produced by the method 100 may be of different shapes depending on the shape of the passages 16 in the mould 10. Thus, as shown in FIGS. 4, 8A, and 8B, a mould 10 with a plurality of square passages 16 could produce ice cubes 50 having a square end. Depending on the dimensions of the passages 16, the mould 10 could form an ice "cube" 50 shaped as a cube or a rectangular prism. Ice cubes of other stackable shapes may also be made based on different formations of the passages 16 in the mould 10.

At step 112, the mould 10 is removed from the pan 20. If the pan 20 has a depth 21, the mould 10 may be removed from the pan 20 by drawing out the mould 10 from the pan 20, for example by pulling the mould 10 upwards or away from the pan 20. The mould 10 may be slid across the face 24 of the pan 20 and away from the pan 22, for example if the pan 20 has no depth. In still another embodiment, if the pan 20 has a depth 21 and at least one sidewall 25 hingedly joined to the base 22 of the pan 20, then the hingedly joined sidewall 25 may be opened to create an opening 27. Similar to above, the mould 10 is slid laterally across the face 24 of the base 22, through the opening 27, and away from the pan 20. The mould 10 may be removed from the pan 20 by being pulled, pushed, or otherwise ejected through the opening 27.

At step 114, the ice cubes 50 are removed from the mould 10. No heating or thawing is used to carry out step 112 of removing the mould 10 from the pan 20. Because the face 24 of the pan 20 is coated with non-stick coating, the mould 10 and the ice cubes 50 in the passages 16 of the mould 10 remove relatively easily from the pan 20. The absence of heating or thawing results in individual ice cubes 50 produced using the method 100 that have a substantially dry outer surface.

Figure 2:
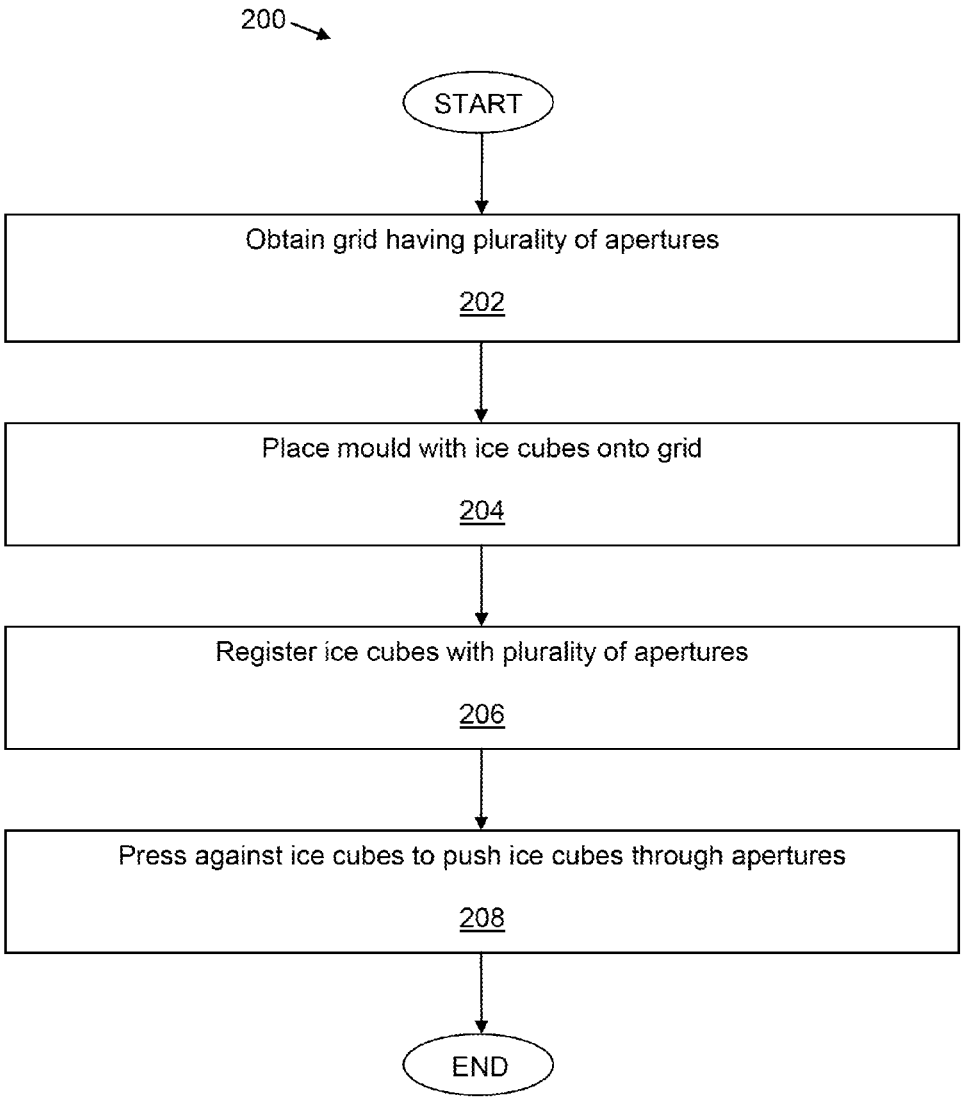
FIG. 2 is a flow chart showing an exemplary method of removing ice cubes from the mould.
Figure 7:
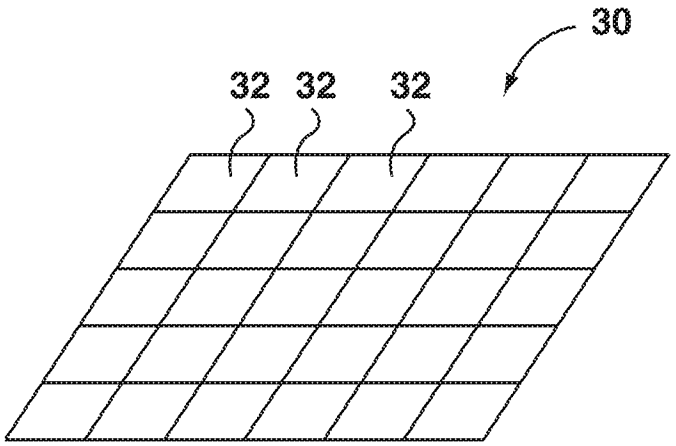
FIG. 7 is a perspective view of a companion grid for the exemplary mould of FIG. 4.

Additionally, no heating or thawing is required to carry out step 114 of removing the ice cubes 50 from the mould 10. In one embodiment, step 114 of removing the ice cubes 50 from the mould 10 may be carried out by a method 200 shown at FIG. 2. At step 202 of the method 200, a grid 30, shown in FIG. 7, is obtained having a plurality of apertures 32. At step 204, the mould 10 with the ice cubes 50 is placed onto the grid 30. At step 206, the ice cubes 50 are registered with the plurality of apertures 32 on the grid 30. Finally, at step 208, the ice cubes 50 are pressed to push the ice cubes 50 through the apertures 32. The steps of the method 200 are completed in order.

Step 114 of removing the ice cubes 50 from the mould 10 may be completed in other ways. For example, in one embodiment the pan 20 has no sidewalls and the mould 10 is moved laterally away from the pan 20. In such an embodiment, the ice cubes 50 may be removed by pressing or knocking into the mould 10 from one surface 12 or 14 of the mould 10 to discharge the ice cubes 50 from the passages 16 of the mould 10. The ice cubes 50 can be similarly removed if the mould 10 has at least one hingedly joined sidewall 26. Removing the ice cubes 50 from the passages 16 in this way results in the ice cubes 50 stacking into a column, thus reducing the space occupied by ice formed using other methods. The substantially dry outer surface of the ice cubes 50 also permits the ice cubes to be in close proximity without significant "sticking" or clumping of the ice cubes 50.

Once the ice cubes 50 are removed from the mould 10, the mould 10 may be returned to the pan 20 to repeat the method 100. Thus, the ice cubes 50 that are discharged in rows corresponding to the passages 16 are again discharged adjacent the rows in repeatable steps to create blocks of ice that can be transported or stored (as discussed below). Although this method is implementable on a large commercial scale, it may also be implementable in household and other freezers.

For example, this method can take place in a freezer where the ambient cool air cools the water in the passages 16 into ice cubes 50. In one embodiment, ice may be made in a freezer where the pan 20 is installed at plane higher than the freezer floor. This higher elevation permits the produced ice cubes 50 to drop into rows that are stacked on top of each other to create an ice block 52. To accommodate the freezer depth while allowing sufficient space for other foods and items in the freezer, the pan 20 may be installed in the back portion of the freezer. The mould 10 is placed on the pan 20. The passages 16 of the mould 10 are filled with water while the ambient cool air of the freezer freezes the water into ice. In this instance, the pan 20 need not have a thermally conductive base as the water could freeze into ice from the ambient cold in the freezer. However, the pan 20 should have a non-stick face 24 for ease of moving the ice while in the mould 10 and subsequently limiting the wetness of the outer surface of the ice cubes 50.

Once the water has frozen into ice or at pre-determined time or at some other point, the mould 10 can be removed from the pan at step 112. In one embodiment, the sidewall 25 of the pan 20 can be opened at the hinged joint 26 to create an opening 27. The sidewall 25 of the pan that is attached with a hinged joint 26 may be at any side of the pan that does not directly register with the freezer wall. In one embodiment, the opening 27 could be facing the freezer front to take advantage of the freezer depth so that the user can access the ice with ease. The mould 10 can then be pushed through this opening 27 and away from the pan 20 while remaining at the same elevation. For example, the mould 10 may slide on the pan 20 because of a railing system joining the mould 10 and the pan 20 or by other methods known to one skilled in the art. In this way, when the mould 10 extends from the pan 20, the ice cubes 50 from the passages 16 can drop vertically to the freezer floor. These ice cubes 50 may have to be removed according to various embodiments of step 114 described above. To ensure the ice cubes 50 that "drop" or are otherwise removed from the passages 16 of the mould 10 stay relatively close to each other, a container (not shown) may be placed adjacent the pan 20 and below the mould 10 when the mould 10 is in its extended configuration. The container would be of corresponding size and shape to the mould 10 to accommodate the ice cubes 50 that are dropped into it.

Once the ice cubes 50 are dropped in a single row or removed from the mould 10 to fit as a single row on either the freezer floor or container, the mould 10 can return to the pan 20 for the above steps to be repeated. Thus, the next row of ice cubes 50 would drop as a row on the single row. In this way, the rows of ice cubes 50 that are formed in the mould 10 are stacked on top of each other in columns to create a block 52 of ice where the ice cubes 50 have a substantially dry surface. The process can be completed in as many cycles as desired to produce ice cubes 50 that reduce the space used in the freezer while also avoiding a heating or thawing step. It is contemplated that the ice block 52 width, height, and length need not be of equal dimensions. While the length and width of the block is governed by the dimensions of the mould, the height of the ice block can vary based on the elevation of the pan 20 and mould 10 in the freezer. Further, multiple ice blocks can be stacked on top of each other or next to each other to create a larger ice block as needed.

Figure 3:
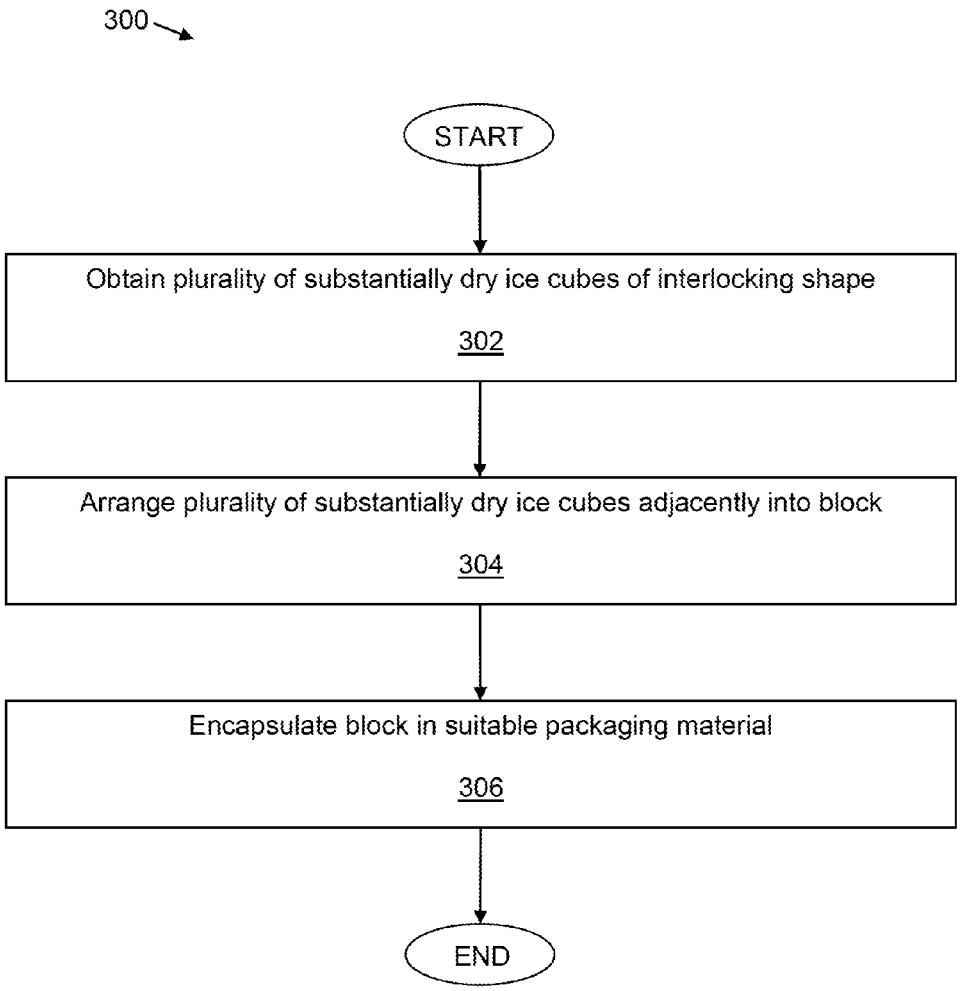
FIG. 3 is a flow chart showing an exemplary method of packaging ice cubes with a substantially dry outer surface.
Figure 9A:
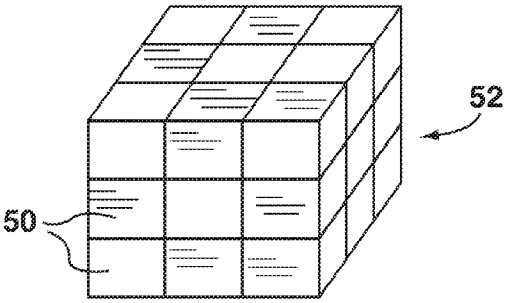
FIG. 9A is a perspective view of a block of ice cubes of FIG. 8A.
Figure 9B:
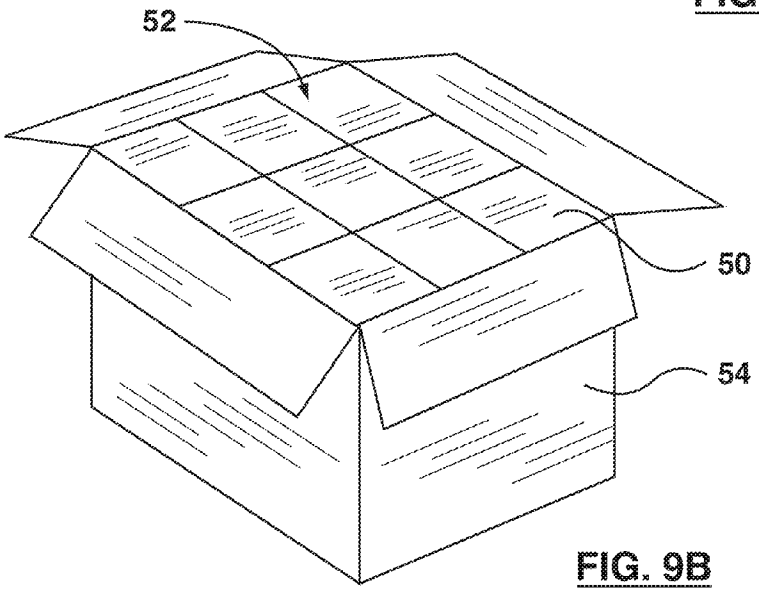
FIG. 9B is a perspective view of the block of ice cubes of FIG. 9A packaged in a waxed cardboard container.

FIG. 3 shows a method 300 of packaging ice cubes. At step 302, a plurality of ice cubes 50 having a substantially dry outer surface and of a stackable shape are obtained. The present application contemplates cubes of any shape with parallel edges extending between a top and bottom face and preferably shapes which are stackable with little or no spaces therebetween. The stackable ice cubes 50 having a substantially dry outer surface are obtained using the method 100. At step 304, the plurality of ice cubes 50 are arranged adjacently into a block 52, shown in FIG. 9A. When arranged adjacently, having a substantially dry outer surface permits the ice cubes 50 to be later separated with greater ease than ice cubes having a wet outer surface. Finally, at step 306, the block 52 is encapsulated in a suitable packaging material 54, shown in FIG. 9B. The packaging material 54 may be plastic bags, plastic sheet, or waxed cardboard among other materials.

The packaging method 300 also lends itself to a method of more efficiently shipping or storing ice which comprises obtaining ice blocks 52 using the method 300 and placing the ice blocks 52 in face-to-face juxtaposition in a refrigerated enclosure. The refrigerated enclosure may be a truck for shipping or a stationary freezer unit for storing.

PARTS LIST

10 mould
12 first surface
14 second surface
16 passages
20 pan
21 depth
22 base
24 face
25 sidewall
26 hinged joint
27 opening
28 cold surface
30 grid
32 apertures
50 ice cubes
52 block
54 packaging material

What is claimed is:

1. A method of producing ice cubes on a commercial scale comprising:

obtaining a mould of food grade silicone having a first surface opposite a second surface and a plurality of passages extending through the first surface and the second surface and being otherwise enclosed between the first surface and the second surface;

obtaining a pan having a thermally conductive base and having a face coated with a non-stick coating;

placing said mould into said pan so that said one of the first and second surfaces of the mould is adjacent said face of the base; filling said plurality of passages of said mould in said pan with water; cooling said base to cause said water in said plurality of passages to freeze away from said base into ice cubes;

removing said mould with said ice cubes from said pan; and removing said ice cubes from said mould;

wherein the steps of removing said mould from said pan and removing said ice cubes from said mould are carried out without any heating or thawing to obtain individual ice cubes with a substantially dry outer surface.

2. The method of claim 1 wherein said thermally conductive base is metal.

3. The method of claim 1 wherein the step of removing the ice cubes from the mould further comprises:

obtaining a grid having a plurality of apertures;

placing the mould with the ice cubes onto said grid;

registering the ice cubes with the plurality of apertures; and pressing against said ice cubes to push the ice cubes through said apertures;

wherein the above four steps are completed in order.

4. The method of claim 1, wherein said pan has a depth defined by at least one sidewall extending orthogonally from said base.

5. The method of claim 4, wherein at least one of said at least one sidewall is hingedly joined to said base of the pan.

6. The method of claim 5, wherein the step of removing the ice cubes from the mould further comprises:

opening said hingedly joined sidewall of the pan to create an opening; and moving said mould laterally across said face of the pan through said opening so that said ice cubes are no longer in registration with said pan.

7. The method of claim 6, further comprising the step of pressing against said ice cubes to push the ice cubes through said passages.

8. The method of claim 1, wherein the step of removing said ice cubes from said mould further comprises moving said mould laterally across said face of the pan until said cubes are no longer in registration with said face of the pan.

9. The method of claim 8, further comprising the step of pressing against said ice cube to push the ice cubes through said passages.

10. A method of packaging ice cubes comprising:

obtaining a plurality of ice cubes with a substantially dry outer surface and of a stackable shape;

arranging said plurality of ice cubes with the substantially dry outer surface adjacently into a block; and encapsulating said block in a suitable packaging material;

wherein said plurality of ice cubes with the substantially dry outer surface are produced by:

obtaining a mould of food grade silicone having a first surface opposite a second surface and a plurality of passages extending through the first surface and the second surface and being otherwise enclosed between the first surface and the second surface;

obtaining a pan having a thermally conductive base and having a face coated with a non-stick coating;

placing said mould into said pan so that said one of the first and second surfaces of the mould is adjacent said face of the base; filling said plurality of passages of said mould in said pan with water; cooling said base to cause said water in said plurality of passages to freeze away from said base into ice cubes; removing said mould with said ice cubes from said pan; and removing said ice cubes from said mould;

wherein the steps of removing said mould from said pan and removing said ice cubes from said mould are carried out without any heating or thawing to obtain individual ice cubes with the substantially dry outer surface.

11. A method of producing ice cubes in cool ambient air, the method comprising:

obtaining a mould of food grade silicone having a first surface opposite a second surface and a plurality of passages extending therethrough through the first surface and the second surface and being otherwise enclosed between the first surface and the second surface;

obtaining a pan having a base and having a face coated with a non-stick coating; placing said mould into said pan so that said one of the first and second surfaces of the mould is adjacent said face of the base;

filling said plurality of passages of said mould in said pan with water;

leaving said water in said passages so that the cool ambient air freezes the water in said plurality of passages into ice cubes;

moving said mould laterally across said face of the pan until said ice cubes are no longer in registration with said face of the pan; and removing said ice cubes from said mould;

wherein the steps of moving said mould laterally across said face of the pan and removing said ice cubes from said mould are carried out without any heating or thawing to obtain individual ice cubes with a substantially dry outer surface.

12. The method of claim 11, wherein the step of removing said ice cubes from the mould comprises pressing against said ice cubes to push the ice cubes through said passages.

13. A method of producing a block of ice cubes in a container that holds the shape of the block of ice cubes and in cool ambient air, the method comprising:

(a) obtaining a mould of food grade silicone having a first surface opposite a second surface and a plurality of passages extending therethrough through the first surface and the second surface and being otherwise enclosed between the first surface and the second surface;

(b) obtaining a pan having a base and having a face coated with a non-stick coating;

(c) placing said mould into said pan so that said one of the first and second surfaces of the mould is adjacent said face of the base;

(d) filling said plurality of passages of said mould in said pan with water;

(e) leaving said water in said passages so that the cool ambient air freezes the water in said plurality of passages into ice cubes;

(f) moving said mould laterally across said face of the pan until said ice cubes are no longer in registration with said face of the pan;

(g) pressing against said ice cubes to push the ice cubes through said passages so that the ice cubes drop as a single row into the container; and repeating steps (c)-(g) so that ice cubes drop in a row above the single row;

wherein the steps of moving said mould laterally across said face of the pan and pressing against said ice cubes from said mould are carried out without any heating or thawing to obtain individual ice cubes with a substantially dry outer surface.

* * * * *